United States Patent [19]

Shimizu et al.

[11] 4,240,055

[45] Dec. 16, 1980

[54] RELEASE TYPE ELECTROMAGNETIC DEVICE FOR CAMERA

[75] Inventors: Masami Shimizu, Tokyo; Teiji Hashimoto, Kawasaki; Hideaki Miyakawa; Masanori Uchidoi, both of Yokohama; Hiroshi Aizawa, Kawasaki; Tadashi Ito, Yokohama, all of Japan

[73] Assignee: Canon Kabushiki Kaisha, Tokyo, Japan

[21] Appl. No.: 847,744

[22] Filed: Nov. 2, 1977

[30] Foreign Application Priority Data

Nov. 15, 1976 [JP] Japan ..... 51-137117

[51] Int. Cl.[3] ..... H01F 7/08

[52] U.S. Cl. ..... 335/234; 335/229

[58] Field of Search ..... 335/234, 230, 229, 81, 335/231

[56] References Cited

U.S. PATENT DOCUMENTS

| | | | |
|---|---|---|---|
| 3,530,454 | 9/1970 | Zocholl | 335/234 |
| 4,020,433 | 4/1977 | Uchidoi | 335/234 |

FOREIGN PATENT DOCUMENTS

| | | | |
|---|---|---|---|
| 2654111 | 6/1977 | Fed. Rep. of Germany | 335/229 |

*Primary Examiner*—Harold Broome

*Attorney, Agent, or Firm*—Toren, McGeady and Stanger

[57] ABSTRACT

In an electromagnetic release for a camera a normally de-energized electromagnet is coupled with unitarally joined elongated pole pieces, and when energized, generates a magnetic flux opposing the magnetic flux of a permanent magnet. A moveable, magnetizable armature adjacent corresponding ends of the pole pieces is normally attracted by the pole pieces as a result of the flux of the permanent magnet when the electromagnet is deenergized. The permanent magnet is positioned between the pole pieces. A spring biases the armature to disengage it from the faces of the pole pieces.

3 Claims, 8 Drawing Figures

RELEASE TYPE ELECTROMAGNETIC DEVICE FOR CAMERA

BACKGROUND OF THE INVENTION

1. Field of the Invention:

This invention relates to an electromagnetic device for a camera, and more particularly to a release type electromagnetic device for a camera.

2. Description of the Prior Art:

Recent, photographic exposure control apparatus for a camera with an electrically controlled shutter have been designed to operate with low power consumption and, at high speed. In an electronically operated magnetic control device of the release type (hereinafter referred to a "release type electromagnetic device") as shown in FIG. 1, an armature 1 is held in the attracted position by the applied magnetic flux from a permanent magnet 4. When the coils 5 and 6 are electrically energized at a desired time, the magnetic flux of the permanent magnet 4 is cancelled. This causes the armature 1 to be drawn away from the attracted position.

In the case of the release type electromagnetic device of FIG. 1, though the consumption of electrical energy is relatively low and the response characteristics is improved, there still exist the following disadvantages: In manufacturing the release type electromagnetic device, the end surfaces 2Aa and 2Ba of the yoke 2 must be subjected to a polishing process after the permanent magnet 4 has been fixedly mounted between the two parts 2A and 2B of the yoke 2 by an adhesive agent. Because the spans L of the yoke 2A and 2B are comparatively long, there is a high possibility of subjecting the yoke 2A and 2B to an inclining or twisting effect during the polishing process. This may cause the aprellelism between the opposite end surfaces **2A*b* and 2B*b* to deviate from the allowable accuracy, for example, usually 0.5 micron. Further, the inclining or twisting effect often results in accidental separation of the permanent magnet 4 from the yoke 2**.

In other words, the conventional type electromagnetic devices, in spite of their various advantages, are very difficult to manufacture and their production yield is low.

SUMMARY OF THE INVENTION

An object of the present invention is to provide a release type electromagnetic device overcomes the above mentioned conventional drawbacks and which is easy to manufacture.

Another object of the present invention is to provide a release type electromagnetic device of small size suited for use in a camera.

Other objects of the present invention will become apparent from the following detailed description taken in conjunction with the accompanying drawings in which:

DESCRIPTION OF THE PREFERRED EMBODIMENTS

Figure 2:
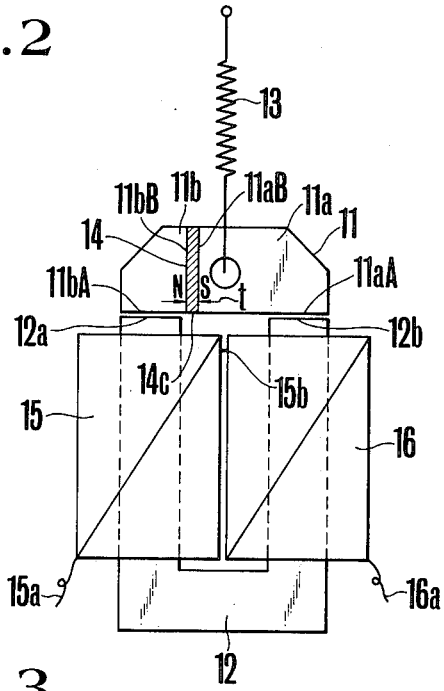
FIG. 2 is an elevational view of an embodiment of a release type electromagnetic device according to the present invention.

FIG. 2 shows a first embodiment of a release type electromagnetic device according to the present invention in an initial position where an armature 11 is attracted. The armature includes parts **11*a* and 11*b* separated by a permanent magnet 14 and in this embodiment made of a soft magnetic iron having a permeability of about $\mu_Y=4.1\times10^{-3}$ (wb/AT.m), or 45 Permalloy. The permanent magnet 14 is oriented as shown in the figure and fixedly secured by an adhesive agent to the end faces 11*b*B and 11*a*B of the armature 11. And, in this embodiment, the permanent magnet 14 is a rare-earth magnet having a permeability $\mu_m=4.4\pi\times10^{-7}$ (Wb/AT·m), a width of $t=1.5\times10^{-4}(m)$ and a cross-sectional area of $Sm=7.8\times10^{-6}(m^2)$ measured at a location at which the magnetic fluxes of electrically energized coils 15 and 16, which will be later described, intersect. The coils 15 and 16 are wound around a yoke 12 in a direction such that a current flowing therethrough from taps 15*a* and 16*a* produces a magnetic flux opposite to that of the magnetic flux of the permanent magnet 14. Wire 15*b* is a connection between the coils 15 and 16. A unitary 12 is formed in the shape of the letter U and made of the same material as that of the armature 11. A spring 13 tends to move the armature 11** upward.

Figure 3:
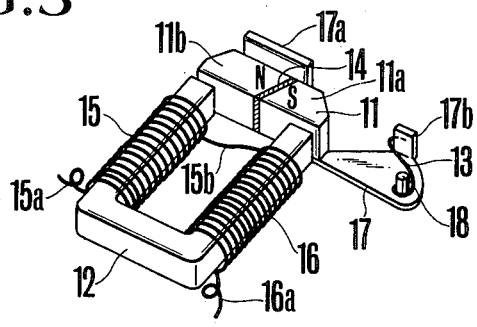
FIG. 3 is a perspective view of a practical example of the release type electromagnetic device of FIG. 2.

Though the outline of the construction of the first embodiment of the present invention has been described above, a practical example of the first embodiment of the present invention will be best understood by reference to FIG. 3. In FIG. 3, the armature 11 shown in FIG. 2 has two parts **11*a* and 11*b* separated by a permanent magnet 14. The yoke of 12 has a U-shape as explained in FIG. 2. The coils 15 and 16 are connected with each other by a connection wire 15*b* and wound around the yoke 12 in such a manner as explained in FIG. 2. Elements 15*a* and 16*a* are taps of the coils 15 and 16 respectively. A support plate 17 fixedly carrying the armature 11 has upwardly extending portions 17*a* and is 17*b* and movably mounted on a pin forming a rotation axis 18. The spring 13 explained in FIG. 2 urges the support plate 17 in a clockwise direction, and acts on between the upwardly extending portion 17*b* of the support plate 17 and the rotation axis 18**.

Figure 4A:
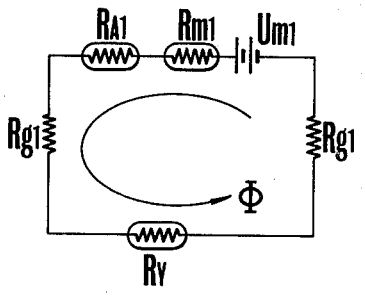
FIG. 4 is an equivalent circuit diagram of the release type electromagnetic device of FIG. 3 with FIG. 4A showing the deenergized state for the coil and FIG. 4B showing the energized state for the coil.
Figure 4B:
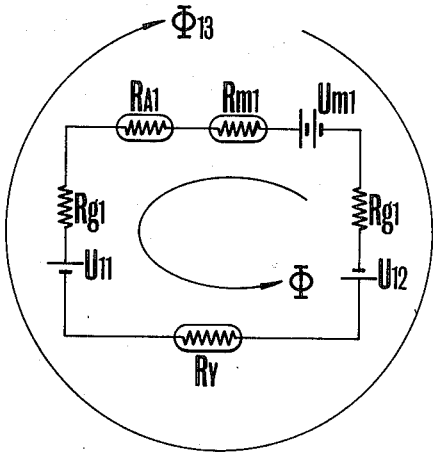

The operation of the first embodiment of the release type electromagnetic device may be understood by using an equivalent circuit of that embodiment as shown in FIGS. 4A and 4B.

At first, the armature 11 is turned by hand or by other methods against the spring 13 until it contacts the end faces **12*a* and 12*b* of the yoke 12. At that time the armature 11 is attracted to the end faces 12*a* and 12*b* of the yoke 12 by the magnetomotive force of the permanent magnet 14. The equivalent circuit of this time is shown in FIG. 4A. Here RA1 denotes the magnetic resistance of the armature 11, Rg1 the magnetic resistance of the air gap formed between the end faces 11***a*A, 11*b*A of the armature 11 and the end faces 12*a*, 12*b* of the yoke, Ry, the magnetic resistance of the yoke, Rm1 the magnetic resistance of the permanent magnet 14 and Um1 the magnetomotive force of the permanent magnet 14. In this manner the magnetic circuit of the first embodiment shown in FIGS. 2 and 3 is equivalent to that shown in FIG. 4A. If Φ denotes the quantity of magnetic flux produced from the permanent magnet 14 and S the cross-sectional area of the contact between the end face 12*a*, 12*b* of the yoke and the end face of the armature 11, then the attracting force F1 between the armature 11 and the yoke 12 becomes:

$$F1=\Phi^2/2\mu\cdot S\times 2-f1 \quad (1)$$

wherein f1 is the tensile force of the spring 13 and $\mu$ is the permeability. In this embodiment, the afore-mentioned attracting force F1 is set as:

$$F1>0 \quad (2)$$

so that the armature 11 continues to adhere to the end faces 12*a* and 12*b* of the yoke 12.

Next, when a current is supplied between the tap 15*a* of the coil 15 and a tap 16*a* of the coil 16, the magnetic flux Φ13 opposite to that of the magnetic flux (see FIG. 4B) supplied from the permanent magnet 14 is produced by the afore-mentioned energized coils 15 and 16. At this time, the magnetic circuit becomes equivalent to that shown in FIG. 4B.

In other words, letting U11 denote the magnetomotive force of the energized coil 15 and U12 the magnetomotive force of the energized coil 16, establishes a closed circuit such as shown in FIG. 4B. Then the attractive force F12 between the armature 11 and the yoke 12 becomes:

$$F12=(\Phi-\Phi_{13})^2/2\mu\cdot S\times 2-f1 \quad (3)$$

In this embodiment, the reversing force of the spring 13 and the current flowing through the coils 15 and 16 are adjusted so that $$F12<0 \quad (4)$$

In consequence, when the coils 15 and 16 are energized, the armature 11 is moved away from the yoke 12.

The aforementioned embodiment, instead of using an ALNICO type permanent magnet (having a reversible permeability of $18\times 10^{-7}$ (Wb/AT·m) as in the conventional electromagnetic device, uses a rare-earth type permanent magnet which has a relatively large magnetic energy and a reversible permeability of about $\frac{1}{4}$ times that of the afore-mentioned ALNICO type magnet, namely, $4\pi\times 10^{-7}$ (wb/AT.m) so that the permanent magnet becomes very thin, and, therefore, the size of the electromagnetic device itself is reduced with advantage.

To explain further, the magnetic resistance Ry of the magnetic circuit made up of the yoke and armature of the device shown in FIG. 2 or FIG. 3 may be expressed as:

$$Ry=l/\mu_Y\cdot S \quad (5)$$

wherein $\mu_Y$ is the permeability of the aforementioned yoke and armature, S is the cross-sectional area of the contact between the afore-mentioned yoke and armature; and l is the length of the magnetic path made up by the afore-mentioned yoke and armature.

The magnetic resistance Rm of the permanent magnet also becomes:

$$Rm=t/\mu_m\cdot S_m \quad (6)$$

wherein t is the width of the permanent magnet, $\mu_m$ is the reversible permeability of the rare-earth type permanent magnet and Sm is the cross-sectional area of the permanent magnet.

Substituting for the above formulas numerical values, namely, $\mu_Y-4.1\times 10^{-3}$ (wb/AT·m), $S=1.95\times 10^{-6}$ ($m^2$), $l=3.6\times 10^{-2}$ (*m*) $\mu_m=4.4\pi\times 10^{-7}$ (wb/AT·m), $Sm=7.8\times 10^{-6}$ ($m^2$) and $t=1.5\times 10^{-4}$ (*m*), we obtain $$Ry=4.5\times 10^6 \text{ (AT/wb)}$$

$$Rm=1.39\times 10^7 \text{ (AT/wb)}$$

$$Rm/Ry\approx 3$$

It will be understood from these magnetic resistance values that in order to use the rare-earth type permanent magnet as the permanent magnet of the device, its width must be made extremely thin. Conversely, the use of the rare-earth type permanent magnet leads necessarily to a large reduction of width with simultaneous reduction of the weight and bulk of the device itself.

It is to be noted that the width of the permanent magnet is specified to 150 microns as being equal to about 1/28 times that of the ALNICO type permanent magnet, it is of course possible that even for this width the necessary attracting force can be obtained.

Figure 1:
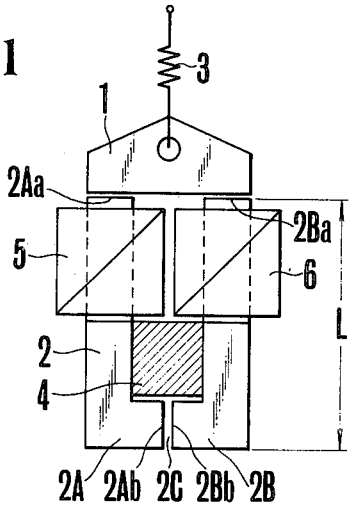
FIG.1 PRIOR ART
FIG. 1 is an elevational view of a typical example of a release type electromagnetic device according to the prior art.

Further, the afore-mentioned first embodiment lacks an air gap 2C (see FIG. 1) which exists in a conventional device. Hence it is possible not only to employ a comparatively rough technique in polishing the end faces 12*a* and 12*b* of the yoke 12, but also to reduce the frequency of damage to the adhering surface of the permanent magnet 14 when the end faces 11aA and 11bA of the armature 11 and the end faces 14*c* of the permanent magnet 14 are polished, because the permanent magnet 14 is sandwiched between the short span armature parts.

Next, the second embodiment of the present invention will be explained by reference to the drawings.

Figure 5:
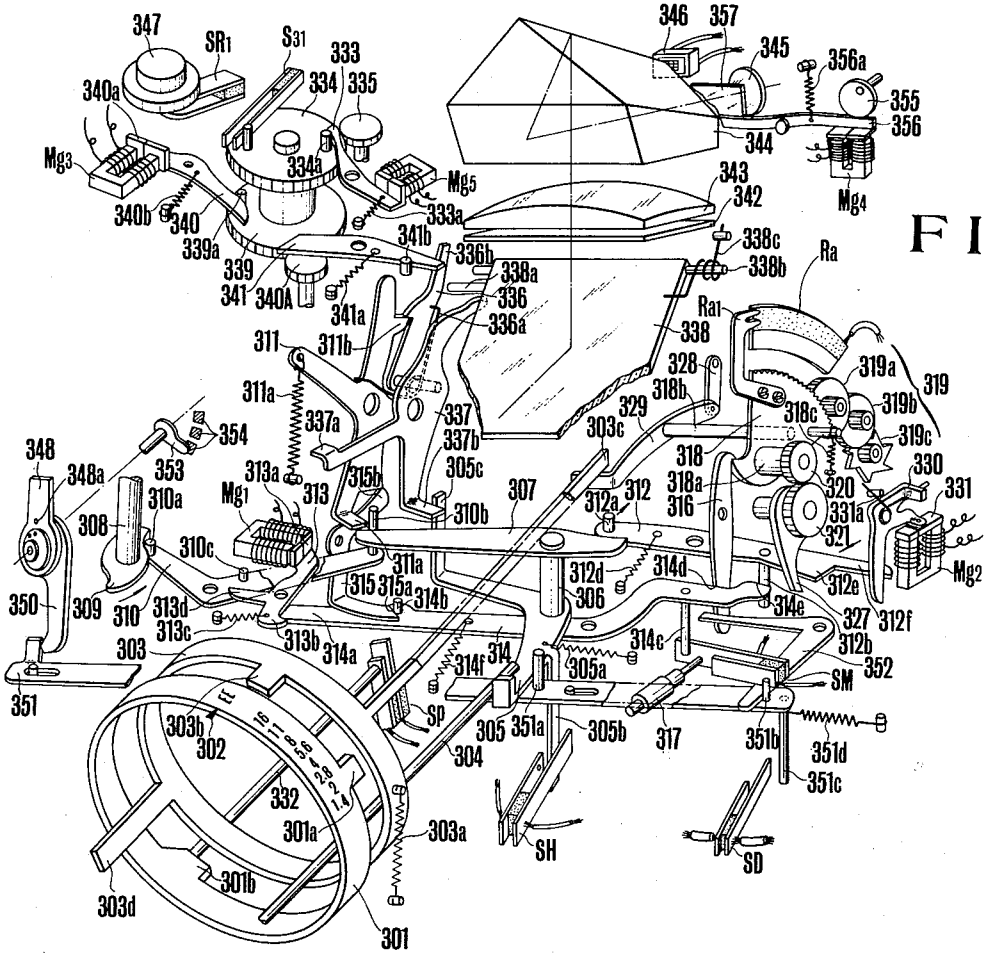
FIG. 5 is an exploded perspective view of an automatic exposure control apparatus for a single lens reflex camera employing a number of devices of the present invention.

FIG. 5 shows an example of application of the device of FIGS. 2 and 3 to a camera operation starter, a self-timer, and diaphragm control and shutter control mechanisms. FIG. 5 particularly shows the basic parts of an internal structure of a single lens reflex camera which are assumed to be in the shutter charged position. At front of the camera, a diaphragm ring 301 carries a symbol EE for automatic diaphragm control and indicia representative of manually selectable diaphragm values it is provided with an extension 301*a* and a cam lob 301*b*, the latter being arranged upon alignment of the symbol EE with a stationary index 302 to push a rod 322 which serves as an actuator for a mode selector switch SP. Positioned behind the diaphragm ring 301 is a presetting ring 303 which is biased by a spring 303*a* in a clockwise direction and which has an extension 303*b* arranged upon actuation of a shutter release to be brought into abutting engagement with the extension 301, an arm 303*c* extending into the path of movement of the diaphragm control mechanism, and an operating member 303*d* for the diaphragm blades controlling the size of diaphragm aperture opening. To close down the diaphragm blades to the setting of the ring 303, a spring (not shown) normally biases an elongated pin 304 into abutting engagement with a drive lever 305 which is biased by a spring 305*a* for movement in a counter-clockwise direction. This drive lever 305 has upwardly and downwardly bent-off portions 305*c* and 305*b*, the latter serving as an actuator for a hold switch SH and fixedly mounted on a rotatable shaft 306 to which is also fixedly mounted an intermediate lever 307.

A film winding shaft 308 has a manually operable lever not shown at the top end thereof and a cam disc 309 at the bottom end thereof. A V-shape lever 310 has two pins 310*b* at the respective ends thereof, the pin 310*a* slidably moving on the camming surface of the disc 309 and the pin 310*b* engaging with one end of the intermediate lever 307 and with one end of a mirror drive lever 311, and an additional pin 310*c* extending into the path of movement of a projection 313*d* of a first latching lever 313 so that the lever 313 can be charged against the force of the spring 313*c*. A lever 312 for energizing the diaphragm control mechanism has a pin 312*a* at one end thereof extending into the path of movement of the opposite end of the intermediate lever 307 and is biased by a spring 312*d* for movement in a counter-clockwise direction.

In order to actuate release of the camera mechanism at the start of an exposure control operation, a first release type electromagnetic device Mg1 of the invention has an armature fixedly carried on one end 313*a* of the first latching lever 313. When the coils of the device are energized, the first latching lever 313 is turned clockwise by the spring 313*c*, with simultaneous disengagement of the pawl 313*b* from a release lever 314 at one end 314*a* thereof. As the release lever 314 is turned counter-clockwise by a spring 314*f*, various portions of the camera are released from their charged positions. The released portions include a mirror mechanism with a second latching lever 315 actuated by a pin 314*b*, the diaphragm control mechanism with a third latching lever 316 actuated by the lever end 314*d*, a second release type electromagnetic device Mg2 with the charge lever 312 actuated at its pin 312*b* by a projection 314*e* and a storage control switch SM actuated at its movable contact by a downwardly extending pin 314*c*. The storage control switch SM can be manually actuated by an EE lock button 317.

The diaphragm control mechanism includes an EE sector gear 318 movable from a latched position by the second latching lever 316 to a position dependent upon the proper diaphragm value as a slider Ra1 radially extending from the sector gear 318 scans the resistance Ra, and a governor 319 in the form of a gear train 319*a* to 319*c* engaging with the sector gear 318. The scanning result is introduced into the lens aperture mechanism through a pin 318*b* interconnecting the sector gear 318 with a control lever 329 which bears the arm 303*c* of the diaphragm presetting ring 303. To arrest the diaphragm control mechanism a lever 330 whose operation is controlled by the second release type electromagnetic device of the invention, fixedly carries an armature 331. A pawl of the arresting lever 330 upon energization of the device, engages one of the teeth of the star gear 319*c* in response to the action of a spring 331*a*. Coaxially an fixedly connected to the sector gear 318 is a gear 320 engaging a gear 321 which has an arm 327 extending into the path of movement of a charge lever projection 312*e*. The arresting lever 330 also has an arm extending into the path of movement of a charge lever end 312*f*. A return spring 318*c* moves the sector gear 318 in the counter-clockwise direction.

The aforementioned mirror drive lever 311 has an unillustrated delay mechanism, is biased by a spring 311*a* for movement in the counter-clockwise direction, and is engaged at one end thereof with the other end of the second latching lever 315. A front curtain latching lever 333 is biased clockwise by a spring 333*a* and fixedly carries an armature for a fifth release type electromagnetic device Mg5 of the invention, at one end thereof. The other end of the lever is shaped as a pawl for latching engagement with a pin 334*a* upwardly extending from a front curtain control gear 334. The front curtain control gear 334 is further provided with an additional pin 334*b* for controlling operation of a start switch S31, and engages a pinion 335 connected to a an unillustrated front curtain drum. The aforementioned mirror drive lever 311 has a pawl 311*b* with which a mirror latching lever 336 is engaged. A spring 336*a* connected to the mirror drive lever 311 tends to move the lever 336 counter-clockwise. The latter pivots about a pin fixedly mounted on a mirror moving up or lifting lever 337 which is pivotal about a common shaft of the mirror drive lever 311. The mirror lifting lever 337 has an arm extending through the wall of the camera housing to the outside thereof so that when a pressure such as from a finger is applied to its end 337*a*, the mirror 338 can be tilted upward at a pair of studs 338*b* through a pin 338*a*-and-lever 377 connection against the force of a return spring 338*c*.

A rear curtain control gear 339 is coaxial with the front curtain control gear 334 and engages a pinion 340A of a curtain drum not shown. Mounted on the upper surface of the gear 339 is a pin 339*a* which cooperates with a latching lever 340 at its pawl. The opposite end of the lever 340 carries an armature 340*a* constituting part of a third release type electromagnetic device Mg3 of the invention. This latching lever 340 is biased by a spring 340*b* for movement in a counter-clockwise direction. To return the mirror 338 from its nonviewing to its viewing position as soon as the rear curtain has run down to close the exposure aperture, the pin 339*a* strikes one end of a lever 341, the opposite end of which normally engages the mirror return control lever end 336*b*.

Light entering through an unillustrated objective lens is reflected by the mirror 338 to a focusing screen 342 on which an image of a scene to be photographed is formed. Light radiated from the focusing screen 342 passes through a condenser lens 343, a penta prism 344 and an eye-piece 345 to an eye of the photographer. Positioned adjacent the exit face of the penta prism 344 is a photo-sensitive element 346 such as a photo-diode.

A shutter release button 347 acts on a first release switch SR1 mounted within the camera housing. A diaphragm closing down lever 348 which also serves as a self-timer setting member is mounted on the front panel of the camera housing. The lever 348 can be turned along with an arm 350 provided that the direction of movement of the lever 348 is clockwise as viewed in the figure. This moves a slide 351 to left. This slide 351 has mounted thereon three pins 351*a*, 351*b* and 351*c* operating with the drive lever 305, an L-shape lever 352, and a changeover switch SD and is biased by a spring 351*d* for movement to right. When the lever 348 is turned counter-clockwise from the illustrated position, an electrical contact member 353 fixedly connected to the shaft 349 successively contacts a number of patches 354 one at a time. At the same time, an eccentric cam disc 355 is turned one revolution. This inserts a light-shielding plate 357 into the path of a light beam between the penta prism 344 and the eye-piece 345. This light-shielding plate 357 is carried on the end of a lever 356 opposite to that at which the cam disc 355 is acted on, and can be maintained stationary in this position because an armature mounted on the lever 356 is attracted by the yoke constituting a fourth release type electromagnetic device Mg4 of the invention along with the armature. When an actuating pulse is applied to the coils of the device Mg4, the lever 356 is turned in a counter-clockwise direction by a spring 356*a*, and at the same time the self-timer setting lever 348 is also returned to the illustrated position.

Figure 6:
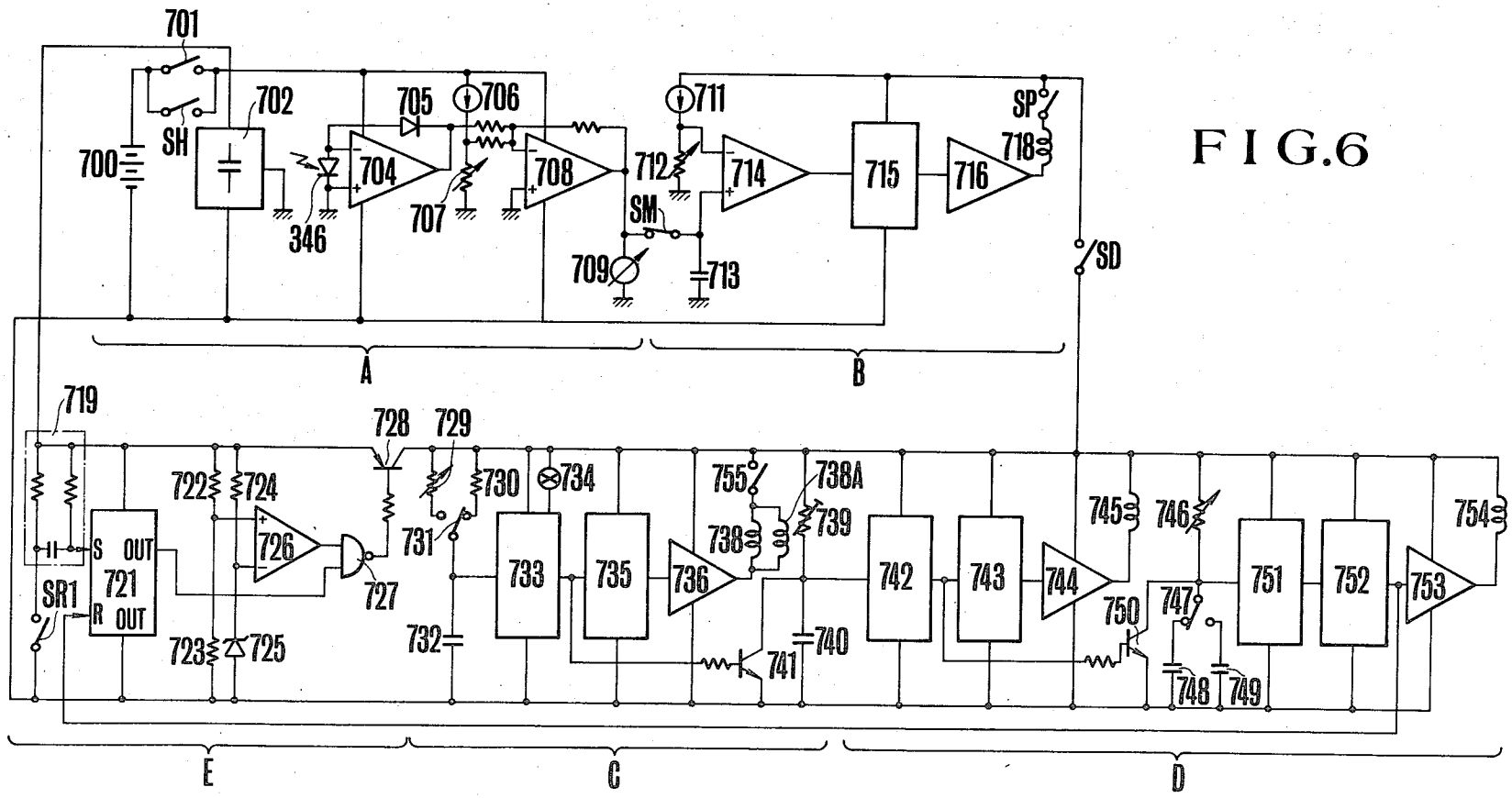
FIG. 6 is a schematic electrical circuit diagram of the apparatus of FIG. 5.

FIG. 6 shows a control circuit for controlling successive actuations of the individual electromagnetic devices Mg1 to Mg4 of FIG. 5 incorporated in an automatic exposure control circuit comprising a light metering circuit A, a diaphragm control circuit B, a camera release control circuit C, a shutter control circuit D and a battery voltage responsive power supply control circuit E.

The light metering circuit A which is of the through-the-lens (TTL) type includes a battery 700, a voltage stabilizer 702 connected through the hold switch SH of FIG. 5 to the battery 700, an operational amplifier 704 having the light sensitive element 346 (see FIG. 5) connected between the inputs thereof, a diode 705 connected in the feedback network of the amplifier 704, a variable resistor 707 for setting therein a combination of preselected film speed and shutter speed, and an adder circuit including an operational amplifier 708. The latter combines the outputs of the operational amplifier 704 and the variable resistor 707 by Apex computation to derive an exposure value, in this instance, diaphragm aperture value which is displayed by a meter 709.

The diaphragm control circuit B includes a storage capacitor 713 connected through the storage control switch SM (see FIG. 5) to the output of the adder circuit. A diaphragm scanning variable resistor 712 is constructed from the slide Ra1 and the resistance track Ra (see FIG. 5) and connected in series with a constant current source 711. A comparator 714 responds to the voltage of the variable resistor 712 reaching a value stored on the capacitor 713 for producing an output which is applied to a mono-stable multi-vibrator 715. The latter produces an actuating pulse which after amplification by an amplifier 716 is applied to the coils 718 of the second release type electromagnetic device Mg2 (see FIG. 5).

The circuit E includes a battery voltage checking circuit and an electrical energy supply control circuit. In the battery checking circuit is composed a voltage of resistors 722 and 723 connected in series to each other between the positive and negative terminals of the battery 700. A reference voltage source of a resistor 724 and a Zener diode 725 are connected in series with each other, and a comparator 726 possesses non-inversion and inversion inputs connected to the outputs of the voltage divider and the constant voltage source respectively. The power supply control circuit includes a differentiating circuit 719 responsive to the closure of the first release switch SR1 (see FIG. 5) for producing a negative pulse. In a bi-stable multivibrator 721 is a set-input connected to the output of the differentiating circuit 719 and a reset-input receives an exposure complete signal from the circuit D. The power control circuit also includes a NAND gate 727 having inputs connected to the respective outputs of the comparator 726 and the multivibrator 721, and a switching transistor 728 responsive to the output of the NAND gate 727 for controlling the period of power supply from the battery 700 to the circuits B, C and D. When the actual voltage of the battery 700 is below a satisfactory operating level, the comparator 726 produces no output so that even when the release switch SR1 is closed, the output of the NAND gate 727 remains at a high level or binary "1" level to maintain the switching transistor 728 in the non-conducting state.

The release actuation control circuit C includes a first delay circuit with a switch 731 selectively connecting a variable resistor 729 and a fixed resistor 730 for self-timer and normal operation respectively with a common capacitor 732, a voltage detector 733 responsive to the output of the delay circuit for producing an output which is applied both to the coils 738 and 738A of the first and fourth devices Mg1 and Mg4 (see FIG. 5) respectively through a common mono-stable multivibrator 735 and amplifier 736 and to a base of a npn transistor 741 of the circuit D.

The shutter control circuit D further includes a second delay circuit of a variable resistor 739 and a capacitor 740 across which the transistor 741 is connected, a voltage detector 742 responsive to the output of the delay circuit for producing an output which is applied both to the coil 745 of the fifth device Mg5 through a mono-stable multivibrator 743 and an amplifier 744 and to a base of a npn transistor 750 connected across either of timing capacitors 748 and 749 which is selectively connected by a switch 747 to a variable resistor 746. A voltage detector 751 responds to the output of the timing circuit for producing an output which is applied to a mono-stable multivibrator 752 and therefrom to amplifier 753. This applies an actuating pulse to the coils 754 of the third device Mg3 controlling the rear shutter curtain. The switch 747 coacts with a shutter speed setting dial (not shown) in such a manner that as the shutter speed is varied from 1/1000 to 32 seconds, switching from the capacitor 748 to the other 749 occurs at about a center in the shutter speed scale, so that the amount of variation of the intensity of current flowing through the variable resistor 746 is decreased. When the fifth device Mg5 for the front shutter curtain is actuated, the transistor 750 is rendered non-conducting with the start of charging of the timing capacitor 748 or 749.

When the third device Mg3 for the rear shutter curtain is actuated, the bi-stable multivibrator 721 in the circuit E is inverted by the output of the mono-stable multivibrator 752 in the circuit D to cause the NAND gate 727 to change the output from "0" to "1" turns the switching transistor 728 off to terminate duration of power supply to the circuits B, C and D.

The operation of the camera of FIGS. 5 and 6 is as follows: When an exposure is to be made in the shutter preselection automatic diaphragm control mode, the operator will first the diaphragm ring 301 to place the symbol "EE" in registry with the stationary index 302 as shown in FIG. 5. The rod 332 is thus pushed by the cam 1ob 301*b* to close the switch SP. Then, a power switch 701 not shown in FIG. 5 is closed by hand to start operation of the light metering circuit A. At this time, information in the form of a voltage proportional to the level of brightness of a scene to be photographed is supplied from the photo-sensitive element 346 through the logarithmic converter of the operational amplifier 704 and the diode 705 to the adder circuit 708. The latter also receives information representative of the combined film speed and shutter speed from the variable resistor 707. The output of the operational amplifier 708 is applied to the meter 709 cooperative with the diaphragm scale and also to the storage capacitor 713 through the storage control switch SM.

When the shutter button 347 is depressed to close the first release switch SR1, the transistor 728 is turned on to effect power supply to the circuits B, C and D. Because of the previous closure of the film winding complete switch 755, the coil 738 of the first electromagnetic device Mg1 is energized in the time interval determined by members 730 and 732. This causes the first latching lever 313 to be turned clockwise under the action of the spring **313*c* until the pawl 313*b* is disengaged from the release lever 314. This then causes the release lever 314 to be turned counter-clockwise by the spring 314*f*. At this time, the storage control switch SM is opened to maintain the voltage on the storage capacitor 713 unchanged, and the mirror drive latching lever 315 is turned by the pin 314*b*. The counter-clockwise movement of the release lever 314 turns the latching lever 316 counter-clockwise at the start of the clockwise movement of the sector gear 318. As the sector gear 318 turns, the control lever 329 is moved downward along with the arm 303*c* of the presetting ring 303 under the action of the spring 303*a* against the force of the spring 318*c*. The sector gear 318 rotates the gears 319*a*, 319*b* and 319*c*, and the slider Ra1 scans the resistance Ra. When the output of the variable resistor Ra1, Ra, 712 has reached a level as detected by the comparator 714, the coil 718 of the second electromagnetic device Mg2 is energized. This causes the armature 331 to be moved away from the yoke by the spring 331*a*. As the lever 330 is turned in the counter-clockwise direction by the spring 331*a*, the stop wheel 319*c* is arrested by the lever pawl 330**, and the scanning result is introduced into the lens aperture mechanism. In other words, the size of diaphragm aperture opening is adjusted in accordance with the object brightness, and the preselected shutter speed and film speed.

The diaphragm is closed down during the diaphragm scanning operation as follows. The clockwise movement of the first latching lever 313 also causes counter-clockwise movement of the mirror drive lever 311 along with the latching lever 336. The turns the mirror moving up lever 337 counter-clockwise. Therefore, the diaphragm closing lever 305 is turned in the clockwise direction. This closes the hold switch SH and the diaphragm blades are driven by the pin 304 to effect automatic formation of the proper diaphragm aperture. On the other hand, the mirror moving lifting lever 337 lifts the pin **338*a* and the mirror 338** is moved from its viewing to its non-viewing position.

When the actuating pulse for the device Mg1 is produced, the second delay circuit 739, 740 starts to operate. The delay time is adjusted so that after the movement of the diaphragm aperture from the maximum to the minimum size has been completed the shutter starts to operate. After the mirror 338 has been set in the non-viewing position, an actuating pulse is applied to the coil 745 of the fifth device Mg5, the front curtain latching lever 333 is turned in the counter-clockwise direction by the spring **333*a* to move away from the pin 334*a*. This permits the front curtain control gear 334 to rotate along with the pinion 335. By the output of the voltage detector 742, the transistor 750 is turned off to start charging of the timing capacitor 748 or 749 through the variable resistor 746 which was preadjusted to the desired shutter speed. At the termination of duration of the preselected shutter time, an actuating pulse is applied to the coil 754 of the third electromagnetic device Mg3. This disengages the rear curtain control gear 339 from the latching lever 340, and therefore the rear curtain is permitted to run. When the running down movement of the rear curtain has been completed, the lever 341 is turned in the counter-clockwise direction by the pin 339*a* and the mirror latching lever 336 is turned in the clockwise direction. The rotation of the mirror latching lever 336 effects disengagement from the mirror drive lever 311. This causes clockwise movement of the mirror moving up lever 337 by the spring 305*a*, and the mirror 338 returns to its initial or viewing position. At the same time, the lever 305 is turned in the counter-clockwise direction by the spring 305*a*, and hence the pin 304 attached on the diaphragm blade drive ring is returned to the initial position. After that, when the film winding lever is operated, the film is advanced one frame and the shutter is charged (or energized). Further the charge lever 312 is operated through the intermediate levers 310 and 307**. Finally, the camera is reset to the illustrated position.

If the EE lock button 317 is depressed, the switch SM is always open so that the light value stored on the capacitor 713 just before the depression of the EE lock button 317 can be used in making subsequent exposures.

When an exposure is to be made in the manual mode, the operator will turn the diaphragm ring 301 to place his desired diaphragm value in registry with the index 302. The cam **1ob 301*b* is moved away from the pin 332 to open the switch SP. Next, when the power switch 701 is closed, the light metering circuit A is rendered operative. When the shutter button 347 is depressed to close the first release switch SR1, the camera release actuation control circuit C is rendered operative to actuate the first electromagnet device Mg1. As the first latching lever 313 is turned in the clockwise direction by the spring 313*c*, the release lever 314 is turned in the counter-clockwise direction under the action of the spring 314*f*, causing the sector gear 318 to be turned under the action of the spring 303*a* but against the force of the spring 318*c* until the projection 303*b* of the presetting ring 303 abuts against the projection 301*a* of the diaphragm ring 301. The counter-clockwise movement of the release lever 314 also causes operation of the automatic diaphragm drive mechanism. That is, movement of the release lever 314 causes clockwise movement of the mirror drive latching lever 315 which in turn causes movement of the diaphragm closing down lever 305. After the mirror 338** is moved to the non-viewing position, the shutter starts to operate in a manner similar to that described in connection with the shutter preselection automatic diaphragm control mode.

Next, the manual diaphragm closing operation for light metering and depth-of-field viewing is as follows. When the diaphragm closing-and-self timer operating lever 348 is turned in the clockwise direction at the axis 349, the slide 351 is moved to left by the lever 350, causing the L-shape lever 352 to be turned in the clockwise direction by the pin 351*b*. This turns the second latching lever 316 in the counter-clockwise direction to release the sector gear 318 from the latched position. As the sector gear 318 is turned, the presetting ring 303 is permitted to assume a position dependent upon the preselected diaphragm value. At the same time, by the pin 351*a*, the diaphragm closing lever 305 is turned at the shaft 306 to drive the pin 304 for movement to the left, thereby the size of diaphragm aperture is varied from the maximum to the preselected diaphragm value. Further, by the pin 351*c*, the diaphragm open-and-close changeover switch SD is opened.

Figure 7:
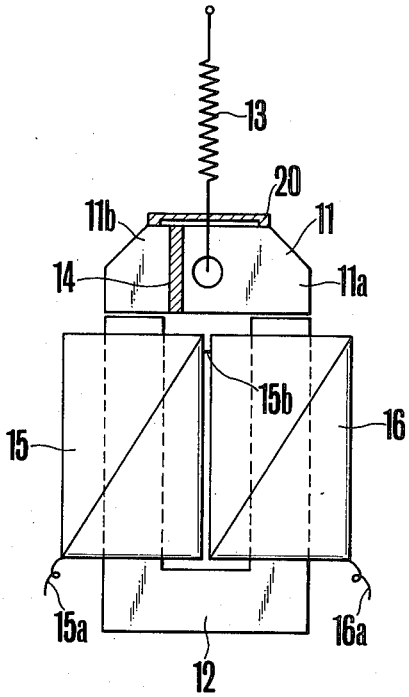
FIG. 7 is an elevational view of another embodiment of a release type electromagnetic device according to the present invention.

FIG. 7 shows another embodiment of the present invention. Here the armature of FIGS. 2 and 3 is provided with an a magnetic flux by-pass plate 20 as positioned on the opposite side to that facing the yoke 12. The other parts remain substantially unchanged from those shown in FIGS. 2 and 3. By selecting different permeability materials for employment in the plate 20, it is made possible to change the operating value of the current for magnetization.

As shown above, according to the present invention, the permanent magnet is incorporated in the armature so that the difficulty of manufacturing the electromagnetic device can be reduced to a large extent. Therefore it is possible to obtain products whose dimensions do not deviate substantially from specific values.

Further, the armature, the yoke and the permanent magnet are made up of the above specified materials and the width of the permanent magnet is reduced to the above specified value so that the resultant electromagnetic device requires a relatively small drive current and has improved response characteristics.

While embodiments of the invention have been described in detail it will be obvious to those skilled in the art that the invention may be embodied otherwise.

What is claimed is:

1. A release type electromagnetic device for a camera, comprising:

(a) integrally constructed pole pieces made of one of soft magnetic iron and 45 permalloy;

(b) a rare-earth permanent magnet;

(c) a normally de-energized coil operatively associated with said pole pieces and operable, when energized, to generate a magnetic flux opposing the magnetic flux of said permanent magnet; and (d) a movable, magnetizable armature which has pole faces and is disposed close to the ends of said pole pieces, said armature being made of one of soft magnetic iron and 45 permalloy, said permanent magnet being fixed between and completely separating the pole faces of said armature; only said pole pieces, said pole faces, and said permanent magnet forming a closed magnetic path; the permanent magnet having a thickness which is small relative to the total length of the magnetic path of the device.

2. A release type electromagnetic device according to claim 1, wherein the width of said permanent magnet is 1/240 times the total length of magnetic path of the device.

3. A release type electromagnetic device according to claim 1, wherein said pole pieces consist of U-shape integrally constructed elongated pole pieces.

* * * * *